US006817701B2

(12) United States Patent
Kitazawa et al.

(10) Patent No.: US 6,817,701 B2
(45) Date of Patent: Nov. 16, 2004

(54) IMAGE FORMING APPARATUS

(75) Inventors: Atsunori Kitazawa, Nagano-ken (JP); Kiyoteru Katsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 146 days.

(21) Appl. No.: 10/225,483

(22) Filed: Aug. 22, 2002

(65) Prior Publication Data

US 2003/0058319 A1 Mar. 27, 2003

(30) Foreign Application Priority Data

| | | |
|---|---|---|
| Aug. 28, 2001 | (JP) | 2001-257183 |
| Aug. 28, 2001 | (JP) | 2001-257184 |
| Sep. 4, 2001 | (JP) | 2001-267207 |
| Sep. 18, 2001 | (JP) | 2001-283530 |

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS

| | | | | |
|---|---|---|---|---|
| 3,689,935 A | | 9/1972 | Pressman et al. | |
| 5,036,341 A | | 7/1991 | Larsson | |
| 5,523,777 A | * | 6/1996 | Kitamura | 347/55 |
| 5,963,495 A | | 10/1999 | Kumar | |
| 5,984,456 A | | 11/1999 | Bern | |

FOREIGN PATENT DOCUMENTS

| | | |
|---|---|---|
| EP | 0 895 867 A2 | 2/1999 |
| EP | 1 065574 A1 | 1/2001 |
| EP | 1 093 033 A1 | 4/2001 |
| JP | 11-115237 A | 4/1999 |
| JP | 2001-505146 | 11/1999 |
| JP | 2000-21180 | 1/2000 |
| JP | 3045295 | 3/2000 |
| JP | 2000-211180 A | 8/2000 |
| JP | 2000-246947 | 9/2000 |
| JP | 2000-355115 | 12/2000 |
| WO | WO 00/69637 A1 | 11/2000 |

* cited by examiner

*Primary Examiner*—Raquel Yvette Gordon
(74) *Attorney, Agent, or Firm*—Sughrue Mion, PLLC

(57) ABSTRACT

The width of a spacer which defines a gap between a development roller and an FPC is set to the width of a toner layer which is carried on the development roller or narrower. This prevents an edge portion of the spacer from getting deformed. In addition, as the spacer is made of a material whose work function is approximately the same as the work function of toner, it is possible to suppress disturbance of a surface potential of the toner layer. Further, for the purpose of maintaining the uniformity of the toner layer, it is desirable to restrict the amount of the toner on the development roller to a predetermined value or smaller.

12 Claims, 12 Drawing Sheets

IMAGE FORMING APPARATUS

BACKGROUND OF THE INVENTION

1. Field of the Invention

The present invention relates to an image forming apparatus such as a copying machine, a facsimile machine and a printer, and more particularly, to an image forming apparatus in which transfer of toner from a toner carrier toward a back electrode is controlled so that the toner adheres to an image receiving member, such as a transfer paper, a copying paper, a recording paper and a transfer medium, and an image is accordingly formed.

2. Description of the Related Art

Most widely used as an image forming method using toner are the jumping development and the projection development. According to these types of image forming methods, an electrostatic latent image corresponding to an image is formed on a photosensitive member and toner serving as an image forming agent is made adhering to the electrostatic latent image on the photosensitive member from a toner carrier, such as a development roller, so that a toner image is created, and after this, the toner image is transferred onto a transfer paper, a copying paper, a recording paper or the like. However, since these image forming methods require a step of forming an electrostatic latent image on a surface of a photosensitive member (exposing process), there is a problem that an apparatus has a complicated structure and a cost regarding the apparatus and a running cost are expensive. Noting this, over the recent years, as disclosed in U.S. Pat. No. 3,689,935, U.S. Pat. No. 5,036,341 and International Publication No. WO 98/24634, an increasing attention has been paid to an image forming apparatus of the so-called "TonerJet (Registered trademark)" method which requires to transfer toner onto an image receiving member, such as a transfer paper, a recording paper and an intermediate transfer belt, under the function of an electric field to thereby form an image.

In such an image forming apparatus, disposed as toner transfer controlling means between a back electrode and a toner carrier which carries and transports electrified toner is a flexible printed circuit (hereinafter referred to as "FPC") which comprises a plurality of toner passing apertures which pass electrified toner, and an image receiving member such as a recording paper and a transfer medium is disposed between the FPC and the back electrode. As a potential difference is applied between the toner carrier and the back electrode, an electrostatic field for transfer of toner develops which makes electrified toner transfer from the toner carrier toward the back electrode. Further, in the FPC, a control electrode is disposed around each toner passing aperture, and as a voltage applied upon each control electrode in accordance with an image signal is controlled, each toner passing aperture is electrostatically opened and closed, the electrified toner is made transfer from the toner carrier toward the back electrode through the toner passing apertures in accordance with the image signal mentioned above, and the toner adheres to the image receiving member. In this manner, a toner image corresponding to the image signal is formed on the image receiving member.

In the case of such an image forming apparatus, for stable creation of a toner image, it is necessary to maintain a small and constant gap between a toner carrier and a control electrode. Noting this, as disclosed in Japanese Patent No. 3045295, Japanese Patent Application Laid-Open Gazette No. 2000-211180 and the like, a gap keeping technology has been proposed which requires to dispose a thin spacer (gap defining means) between a toner carrier and an FPC to thereby keep the gap constant. In other words, as the spacer is inserted between the toner carrier and the FPC, the gap is maintained constant to approximately the thickness of the spacer.

Meanwhile, for the purpose of forming a toner image whose density is less uneven and whose image quality is excellent, a toner layer to be formed on a toner carrier must be uniform. However, in an image forming apparatus as above wherein a spacer is disposed between a toner carrier and an FPC, a toner layer on the toner carrier is in contact with the spacer. Hence, in conventional apparatuses, the uniformity of the toner layer on the toner carrier is disturbed as the toner layer contacts the spacer, and the image quality accordingly degrades in some cases.

In order to stably form a toner image having an excellent image quality, therefore, it is necessary to meet two requirements, one for a constant gap and the other for the uniformity of a toner layer on a toner carrier. However, there has been no apparatus which satisfies the both requirements.

SUMMARY OF THE INVENTION

A major object of the present invention is to provide an image forming apparatus in which the uniformity of a gap and the uniformity of a toner layer both improve and a toner image having an excellent image quality is formed stably.

The present invention is directed to an image forming apparatus which comprises: a back electrode; a toner carrier which transports a toner layer, which is formed by electrified toner, to a toner transfer starting position which is faced with the back electrode while carrying the toner layer and moving in a predetermined travel direction; and toner transfer controlling means which is disposed between the toner carrier and the back electrode and controls toner transfer from the toner transfer starting position on the toner carrier toward the back electrode so that toner arrives at an image receiving member which is transported between the back electrode and the toner transfer controlling means and a toner image is accordingly formed.

In fulfillment of the foregoing object, a first aspect of the image forming apparatus further comprises gap defining means which comes in contact with the toner layer and accordingly defines a gap between the toner carrier and the toner transfer controlling means. The gap defining means has a width in a width direction, which is perpendicular to the travel direction of the toner carrier, smaller than a width of the toner layer in the width direction and comes in contact with the toner layer within both edge portions of the toner layer in the width direction.

According to a second aspect of the present invention, the image forming apparatus further comprises gap defining means which defines a gap between the toner carrier and the toner transfer controlling means. The gap defining means is made of a material having a work function approximately the same as a work function of the toner, and comes in contact with the toner layer at an upstream position to the toner transfer starting position in the travel direction of the toner carrier.

According to a third aspect of the present invention, the image forming apparatus further comprises toner restricting means which restricts quantity of the toner layer on the toner carrier to a predetermined value at an upstream position to the toner transfer starting position in the travel direction of the toner carrier; and gap defining means which comes in contact with the toner layer at a position between the toner transfer starting position and the toner restricting means and defines a gap between the toner carrier and the toner transfer controlling means. The image forming apparatus is characterized in that the toner restricting means restricts a thickness of the toner layer to smaller than 2d where the symbol d denotes a volume mean diameter of the toner.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENTS

Figure 1:
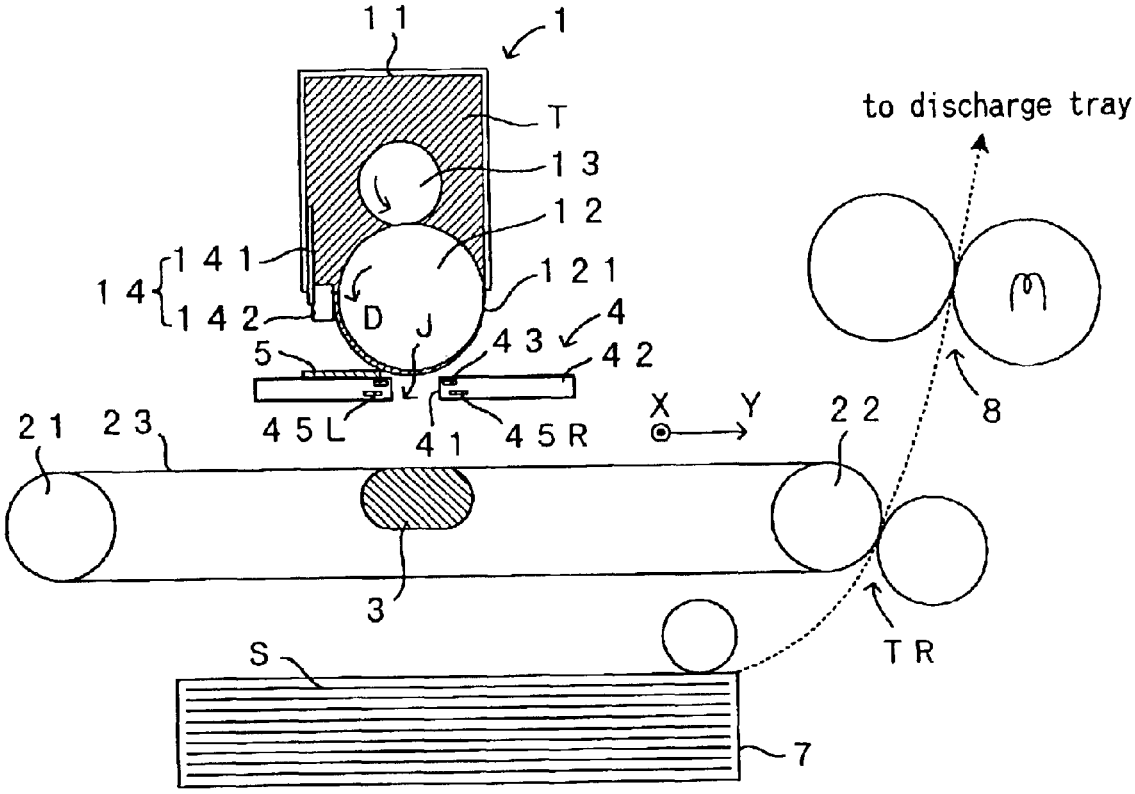
FIG. 1 is a drawing of a first preferred embodiment of an image forming apparatus according to the present invention.
Figure 2:
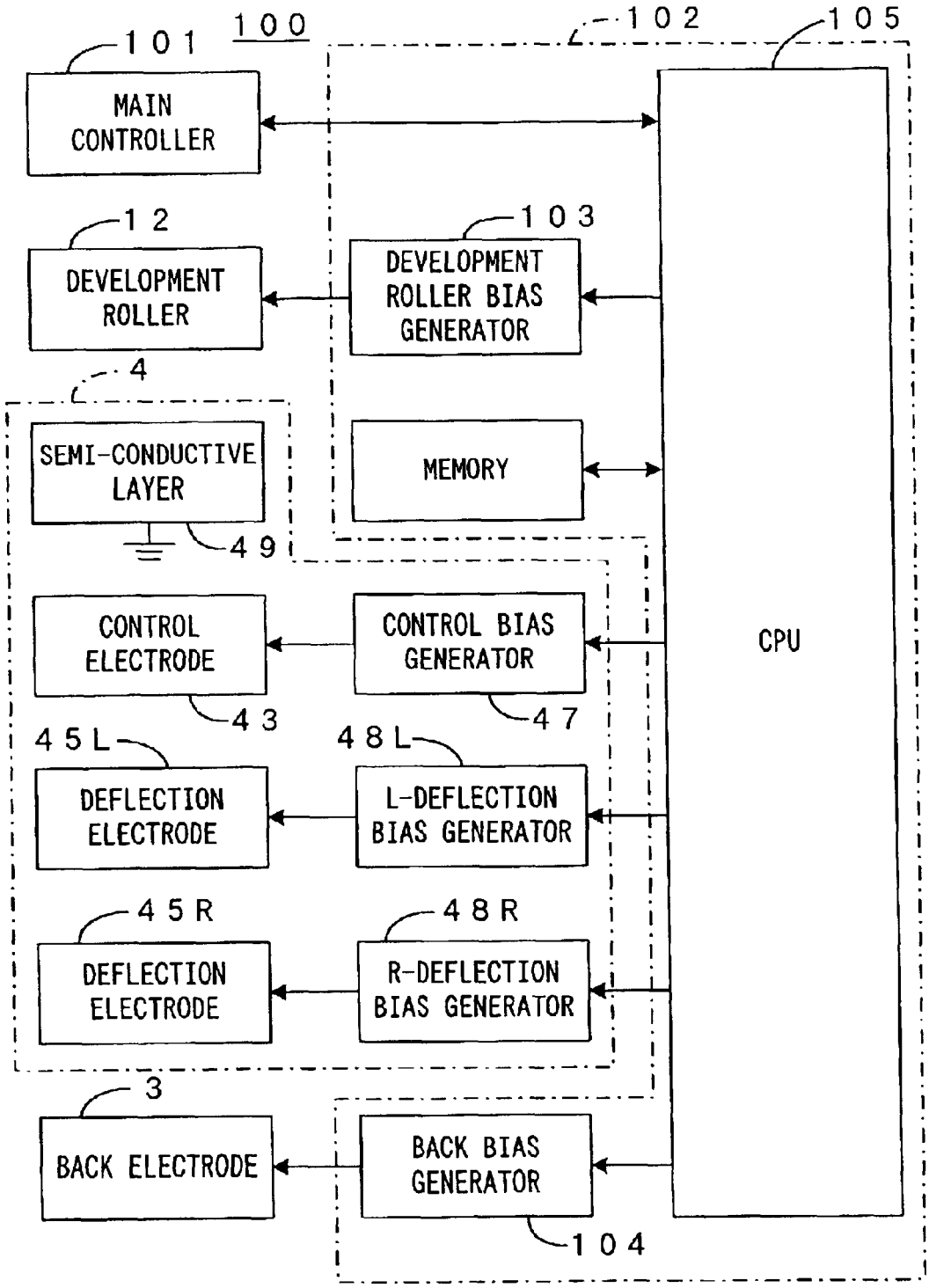
FIG. 2 is a block diagram showing an electric structure of the image forming apparatus shown in FIG. 1.

FIG. 1 is a drawing of a first preferred embodiment of an image forming apparatus according to the present invention. FIG. 2 is a block diagram showing an electric structure of the image forming apparatus shown in FIG. 1. In this image forming apparatus, as an image signal is supplied from an external apparatus such as a host computer to a main controller 101 of a control unit 100, and an engine controller 102 controls respective portions of a developer 1 in accordance with a signal from the main controller 101. This makes toner transfer toward an intermediate transfer belt 23 which is stretched around two rollers 21 and 22, the toner adheres to the intermediate transfer belt 23, and a toner image corresponding to the image signal is formed. Thus, the intermediate transfer belt 23 functions as an image receiving member in this embodiment.

In the developer 1, toner T serving as a developer agent is stored within a housing 11, and a development roller 12, a supply roller 13 and a regulating blade 14 are housed in the developer 1. The development roller 12 is a toner carrier which carries electrified toner (namely, electrified particles for creation of images) T, rotates at a predetermined peripheral velocity in an arrow direction D shown in FIG. 1 and accordingly transports the toner to a position (toner transfer starting position) J which is faced with a back electrode 3 which will be described later.

The development roller 12 is formed into a cylindrical shape and made of metal, such as aluminum and iron, or metal alloy, and comprises on its surface an insulation layer 121 which is an insulation coating such as urethane resin. Because of the insulation layer 121 thus disposed on the surface of the development roller 12, electrification (easiness of electrification) of the toner T due to friction against the supply roller 13 and the toner regulating blade 14 improves, which in turn makes it possible to separate the toner T from the development roller 12 with smaller force. Hence, it is possible to make the toner T transfer efficiently at the toner transfer starting position J. Further, a volt direct current is applied upon the development roller 12 from a development roller bias generator 103 which is disposed to the engine controller 102.

Brought into contact with an outer periphery of the development roller 12, the supply roller 13 rotates in an opposite direction to that of the development roller 12, thereby supplying the toner T to the development roller 12 and removing an excessive amount of the toner T from the development roller 12. The supply roller 13 is obtained by winding synthetic rubber such as urethane sponge around a metallic core for instance, and as the supply roller 13 comes into frictional contact with development roller 12, the supply roller 13 electrifies the toner T to a predetermined polarity. This embodiment will be continuously described below on the premise that the toner T is electrified to the negative polarity.

At a downstream position relative to the supply roller 13 in the direction D of rotation of the development roller 12, the regulating blade 14 is brought into contact with the outer periphery of the development roller 12 and accordingly electrifies the toner T to the negative polarity owing to friction with the development roller 12 while regulating the quantity of the toner T carried on the development roller 12. More specifically, the regulating blade 14 is formed by a plate-shaped metallic piece 141 which is fixed at its one end to the housing 11 and an elastic element 142 which is attached to the other end of the plate-shaped metallic piece 141. The elastic element 142 contacts the outer periphery of the development roller 12 and restricts the toner T. Thus, according to this embodiment, the regulating blade 14 functions as toner restricting means of the present invention. On the downstream side relative to the regulating blade 14 in the direction D of rotation of the development roller 12 (i.e., the feeding direction of the toner T) the regulating blade 14 restricts the thickness of a toner layer on the development roller 12 to 1d (where the symbol d is a volume mean diameter of the toner T). The reason of restricting the thickness of the toner layer to 1d will be described in detail later.

The back electrode 3 is arranged to face with the development roller 12. More particularly, the back electrode 3, as shown in FIG. 1, is located on the opposite side of the intermediate transfer belt 23 to the development roller 12. A volt direct current which is higher than the voltage applied upon the development roller 12 is applied to the back electrode 3 from a back bias generator 104 which is disposed to the engine controller 102, whereby an electrostatic field for transfer which moves the toner T toward the back electrode 3 develops between the development roller 12 and the back electrode 3. Hence, because of the electrostatic field for transfer, the electrified toner T transfers toward the back electrode 3 from the development roller 12 at the toner transfer starting position J, and arrives at and adheres to the surface of the intermediate transfer belt 23 which serves as an image receiving member.

In addition, according to this embodiment, for the purpose of controlling transfer of the electrified toner T toward the intermediate transfer belt 23, a flexible printed circuit (hereinafter referred to as "FPC") 4 is disposed between the development roller 12 and the back electrode 3. The structure and the function of the FPC 4 will now be described with reference to FIGS. 3 and 4.

Figure 3:
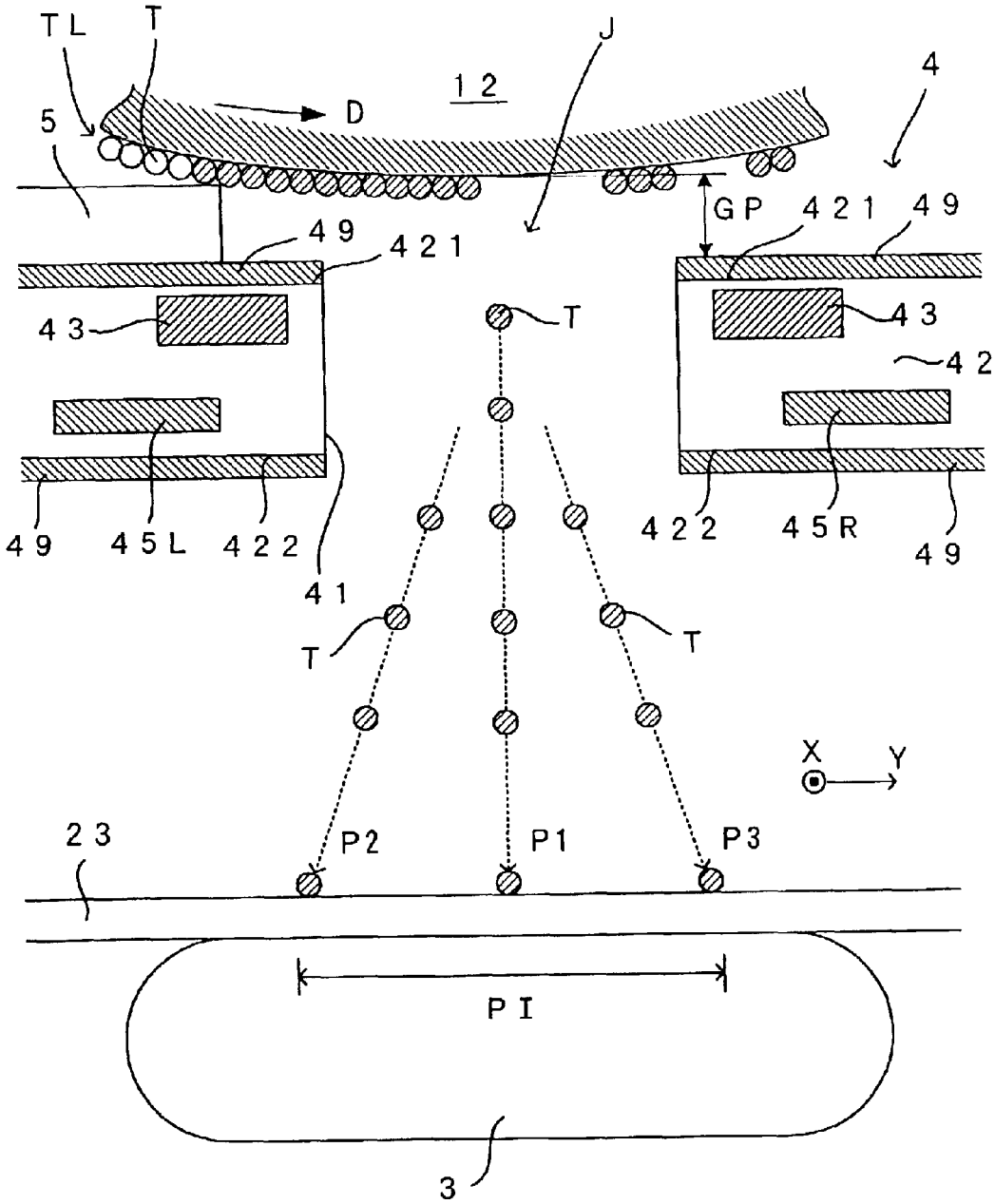
FIG. 3 is a partially expanded cross sectional view of a flexible printed circuit and a drawing which shows a toner transfer model.
Figure 4:
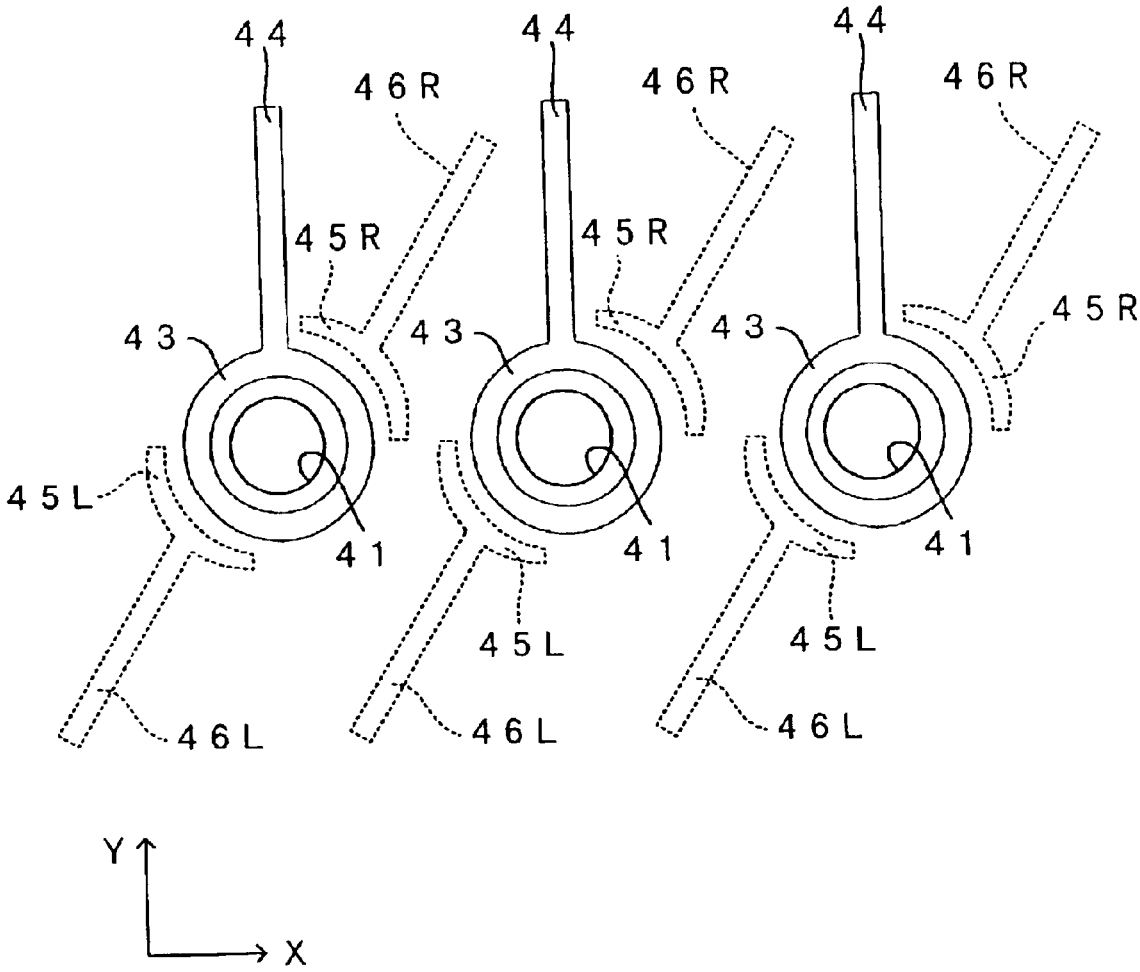
FIG. 4 is a drawing which shows control electrodes and deflection electrodes which are formed in a flexible printed circuit.

FIG. 3 is a partially expanded cross sectional view of the flexible printed circuit and a drawing which shows a transfer model of the electrified toner. FIG. 4 is a drawing which shows control electrodes and deflection electrodes which are formed in the flexible printed circuit. In this FPC 4, toner passing apertures 41 for guiding the electrified toner T to the back electrode 3 from the development roller 12 are formed in a base member 42 which is made of an electrical insulation material such as polyimide. Although only one toner passing aperture 41 is shown in FIG. 3, a plurality of toner passing apertures 41 are formed equidistantly in the form on one train in a direction perpendicular to the plane of FIG. 3 so that the electrified toner T can travel through the respective toner passing apertures 41 toward the back electrode 3 according to this embodiment. While this embodiment requires to arrange the toner passing apertures 41 in one train, the toner passing apertures 41 may be arranged in more one trains. In addition, with respect to the shape of the toner passing apertures 41, the toner passing apertures 41 may be round as in this embodiment, or alternatively, oval or polygonal.

Further, on the development roller 12 side of the base member 42, a control electrode 43 is formed in the shape of a ring to surround each toner passing aperture 41. From each control electrode 43, a lead line 44 runs in a direction perpendicular to the direction of the arrangement of the toner passing apertures 41. The shape of the control electrodes 43 is not limited to a circular shape, but may be any desired shape, such as an oval or polygonal shape for example, or further alternatively, a partially notched ring shape instead of a perfect ring shape.

Moreover, on the back electrode 3 side of the base member 42, for each toner passing aperture 41, paired deflection electrodes 45L and 45R are disposed so as to obliquely face with each other with respect to a feeding direction (i.e., a direction perpendicular to the train of the toner passing apertures) Y of the intermediate transfer belt 23 as shown in FIG. 4, and lead lines 46L and 46R extend respectively from the deflection electrodes 45L and 45R.

Although not shown in FIGS. 3 and 4, a control bias generator 47 (FIG. 2), an L-deflection bias generator 48L (FIG. 2) and a R-deflection bias generator 48R (FIG. 2) composed of high-voltage driver ICs are formed in the base member 42. Of these, the control bias generator 47 is electrically connected with each control electrode 43, and therefore, as an appropriate voltage is selectively applied in accordance with an open/close control signal from a CPU 105 of the engine controller 102, the toner passing apertures 41 described above electrostatically open and close. In other words, the electrostatic field for transfer is exposed between the development roller 12 and the back electrode 3 through the toner passing apertures 41 in such a manner that owing to the respective control electrodes 43, the electrified toner T jumps from the development roller 12, passes through the toner passing apertures 41 and transfers toward the back electrode 3. On the other hand, the exposure is limited, to thereby restrict transfer of the toner.

The L-deflection bias generator 48L is electrically connected with the deflection electrodes 45L, whereas the R-deflection bias generator 48R is electrically connected with the deflection electrodes 45R. As an appropriate voltage is selectively applied to each one of the deflection electrodes 45L and 45R in accordance with a deflection control signal supplied from the engine controller 102, the trajectory of the electrified toner T is switched among three directions described below.

(1) No Deflection: Arrow P1 in FIG. 3

When the same voltage is applied to both the deflection electrodes 45L and 45R, as denoted at the arrow P1 in FIG. 3, the electrified toner T passes straight through the toner passing aperture 41 and transfers onto a position corresponding to this toner passing aperture 41 on the intermediate transfer belt 23.

(2) Deflection to the Left: Arrow P2 in FIG. 3

When a higher voltage is applied to the deflection electrode 45L which is located on the left-hand side to the toner passing aperture 41 as compared to a voltage applied to the deflection electrode 45R which is located on the right-hand side to the toner passing aperture 41, the electrified toner T which is electrified to the negative polarity is deflected toward the left-hand side as denoted at the arrow P2 in FIG. 3 because of a deflecting electrostatic field which develops between the two deflection electrodes 45L and 45R.

(3) Deflection to the Right: Arrow P3 in FIG. 3

When a higher voltage is applied to the deflection electrode 45R which is located on the right-hand side to the toner passing aperture 41 as compared to a voltage applied to the deflection electrode 45L which is located on the left-hand side to the toner passing aperture 41, the electrified toner T which is electrified to the negative polarity is deflected toward the right-hand side as denoted at the arrow P3 in FIG. 3 because of a deflecting electrostatic field which develops between the two deflection electrodes 45L and 45R.

In this manner, according to this embodiment, while the trajectory of the electrified toner T is switched among the three directions, the electrified toner T transfers to a point of impact PI on the intermediate transfer belt 23 including the range of deflection.

However, since the deflection electrodes 45L and 45R are located facing with each other in an oblique direction to the feeding direction Y of the intermediate transfer belt 23 as described above, in the three conditions above of (1) no deflection, (2) deflection to the left-hand side and (3) deflection to the right-hand side, when the intermediate transfer belt 23 is in a halt, three dots are formed on the intermediate transfer belt 23 which line up straight obliquely to the feeding direction Y of the intermediate transfer belt 23. In this case, if the feeding speed of the intermediate transfer belt 23 is set so as to advance the intermediate transfer belt 23 a quantity of deviation (distance) between adjacent dots in a dot printing cycle (period of time), the three dots will line up straight in a direction perpendicular to the feeding direction Y of the intermediate transfer belt 23. This allows to form three dots through one toner passing aperture 41, and hence, to increase the density of the dots.

Antistatic semi-conductive layers 49 are formed on a surface 421 on the development roller 12 side of the base member 42 and a surface 422 of the back electrode 3 side of the base member 42, and a ground potential is applied to the semi-conductive layers 49. These semi-conductive layers 49 have an optimal resistance value at a pre-set temperature (initial setup temperature), and release from the FPC 4 frictional charges which develop as the electrified toner T transferring as described above comes into contact with the FPC 4. This effectively prevents electrification of the FPC 4 and suppresses an influence over the electrostatic field for transfer and the deflecting electrostatic field. In short, it is possible to maintain an excellent printing quality while the temperatures of the semiconductive layers 49 are kept at the initial setup temperature or within a tolerable temperature range.

On the upstream side to the toner transfer starting position J in the direction D of rotation of the development roller 12, between the FPC 4 having such a structure as described above and the development roller 12, a spacer 5 which expands in the longitudinal direction X of the development roller 12 (a direction perpendicular to the plane of FIG. 3) is inserted to the forward side to the toner passing apertures 41 of the FPC 4 as viewed from the rotation direction D. As the spacer 5 partially abuts on the toner layer TL which is carried on the development roller 12, a gap GP between the development roller 12 and the toner passing apertures 41 of the FPC 4 is defined so as to stay at a constant value. In this manner, according to this embodiment, the spacer 5 functions as gap defining means.

In the image forming apparatus having such a structure as described above, as the image signal is supplied from an external apparatus to the main controller 101 of the control unit 100, the main controller 101 outputs a signal corresponding to the image signal to the engine controller 102. In the engine controller 102 receiving this signal, the CPU 105 supplies a control signal corresponding to this signal to the control bias generator 47, the L-deflection bias generator 48L and the R-deflection bias generator 48R, whereby the toner T transfers and adheres onto the intermediate transfer belt 23 and a toner image corresponding to the image signal is formed. In a predetermined transfer region TR, the toner image is transferred onto a sheet S, such as a transfer paper and a transparent sheet for an overhead projector, which is retrieved from a cassette 7. The sheet S now seating the image is then conveyed to a discharge tray not shown via a fixing unit 8.

Figure 5:
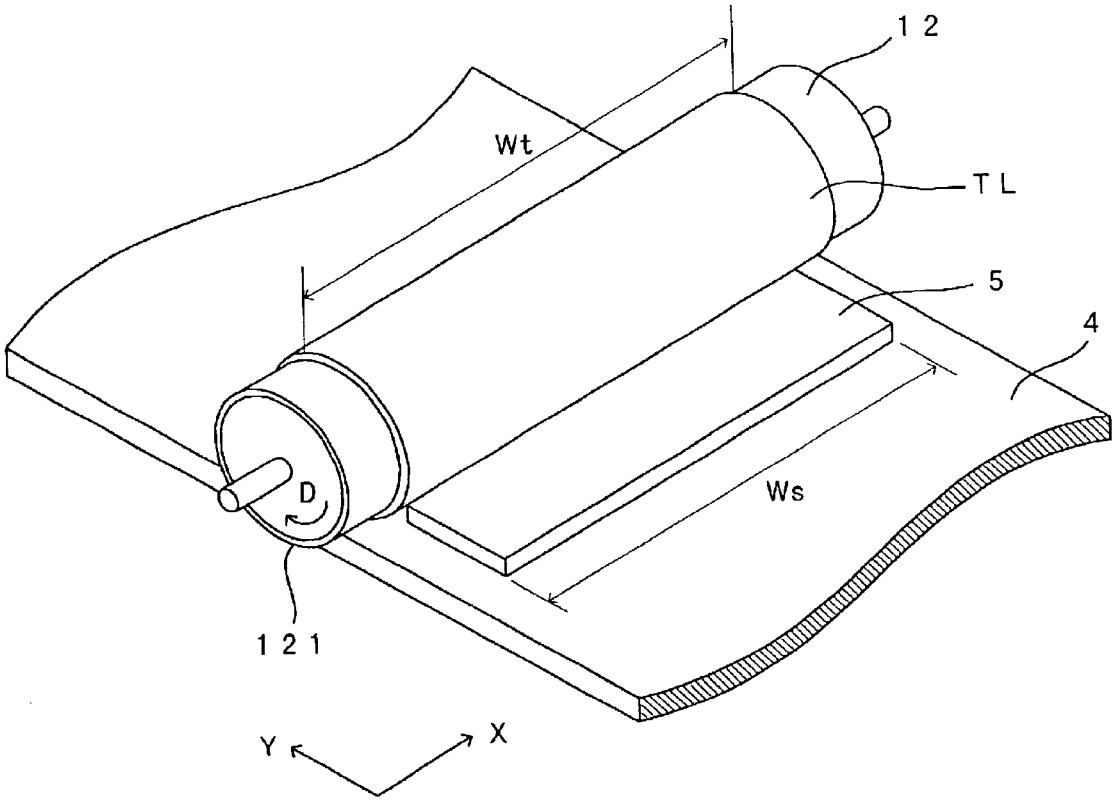
FIG. 5 is a perspective view showing a contact portion between a spacer and a toner layer in this image forming apparatus.
Figure 6:
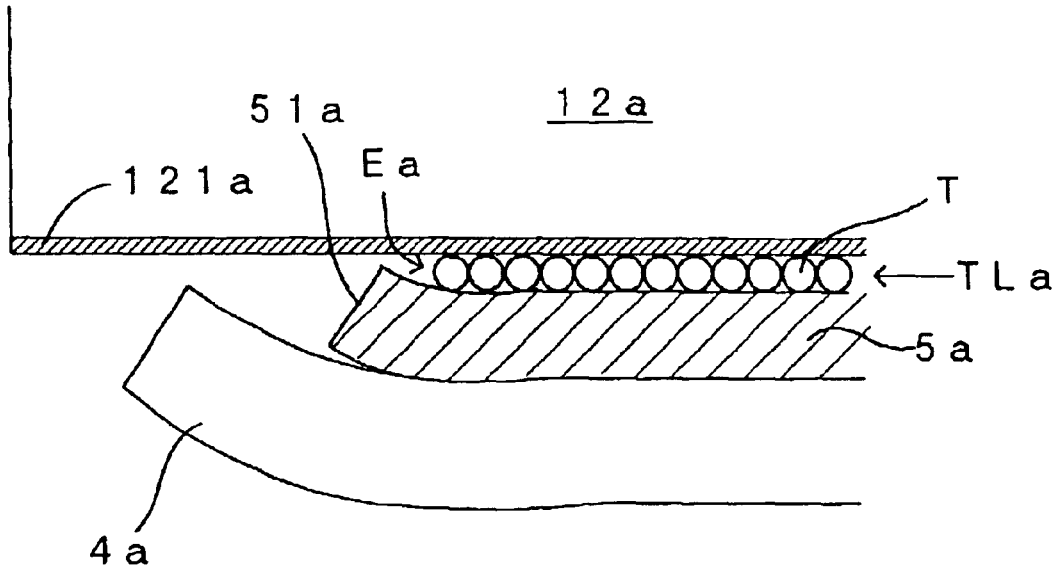
FIG. 6 is a drawing which shows an edge portion of a spacer in a conventional image forming apparatus.
Figure 7:
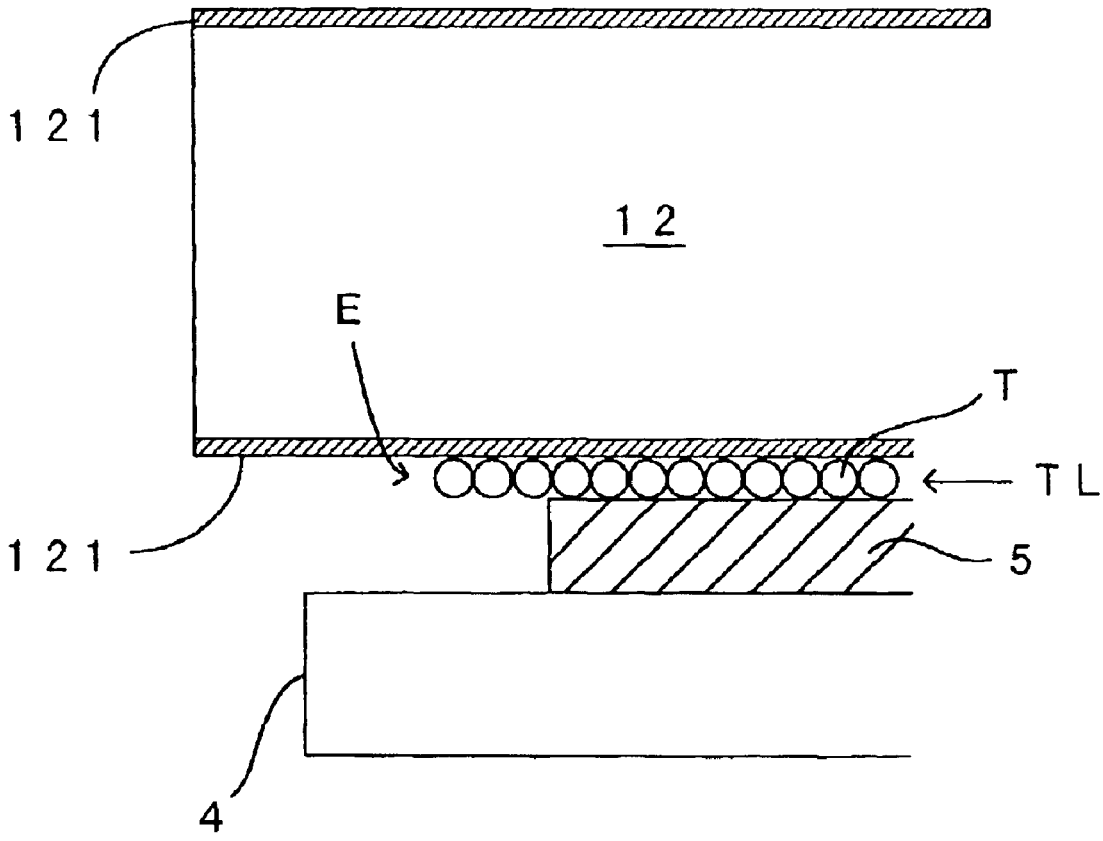
FIG. 7 is a drawing which shows an edge portion of a spacer according to the first preferred embodiment.

A state in which the spacer 5 and the toner layer TL contact each other will now be described in more detail with reference to FIGS. 5 through 7. FIG. 5 is a perspective view showing a contact portion between the spacer and the toner layer in this image forming apparatus. FIG. 6 is a drawing which shows an edge portion of a spacer in a conventional image forming apparatus. FIG. 7 is a drawing which shows an edge portion of the spacer according to the first preferred embodiment.

In the image forming apparatus shown in FIG. 1, while the toner layer TL of the toner T electrified by the supply roller 13 and the regulating blade 14 is formed on the surface of the development roller 12, the toner layer TL is formed over a width Wt within the surface of the development roller 12 as shown in FIG. 5. On the other hand, the width Ws of the spacer 5 is smaller than or equal to the toner layer width Wt, i.e., to meet $Ws \leqq Wt$.

Japanese Patent Application Laid-Open Gazette No. 2000-355115 discloses an image forming apparatus in which the spacer width Ws is larger than the toner layer width Wt. In an apparatus having such a structure, as shown in FIG. 6, an edge portion 51*a* of a spacer 5*a* extends outwards beyond an edge portion Ea of a toner layer TLa. Since the spacer 5*a* is formed thin, the spacer 5*a* may be deformed along the direction of a development roller 12*a*. In this case, an FPC 4*a* as well may be deformed together, which in turn may partially deform a gap, hinder stable transfer of toner and accordingly degrade the quality of a toner image.

In contrast, in the image forming apparatus according to this embodiment, as shown in FIG. 7, since the spacer 5 terminates inside an edge portion E of the toner layer TL, the spacer 5 will not be deformed unlike the above. Hence, the FPC 4 will not be deformed either, which allows to maintain the gap GP constant and stably form a toner image.

Since the width Wt of the toner layer TL is determined by the width of the regulating blade 14 which forms the toner layer TL on the development roller 12, for the purpose of forming the toner layer TL having the predetermined width Wt, the width of the regulating blade 14 may be set to Wt and the width of the supply roller 13 may be set equal to or larger than this for example.

While the foregoing has just described the example that the spacer 5 is disposed on the upstream side to the toner transfer starting position J in the direction D of rotation of the development roller 12, the description just above similarly applies to a structure in which the spacer 5 is disposed to the downstream side to the toner transfer starting position J.

Figure 8:
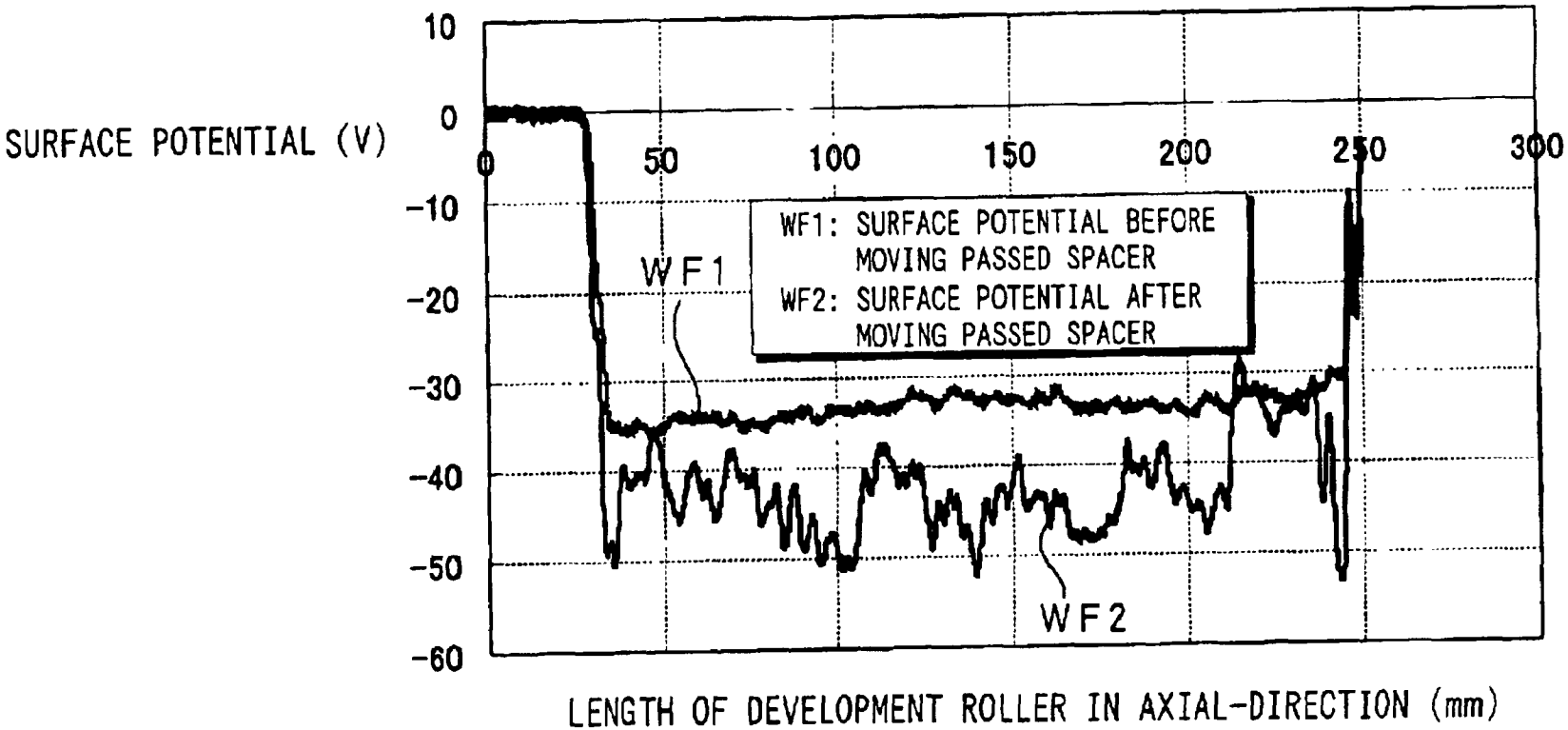
FIG. 8 is a drawing which shows surface potentials of a toner layer before and after the toner layer moves passed a spacer in a condition that the work function of the spacer and the work function of toner which forms the toner layer have a relatively large difference between each other.
Figure 9:
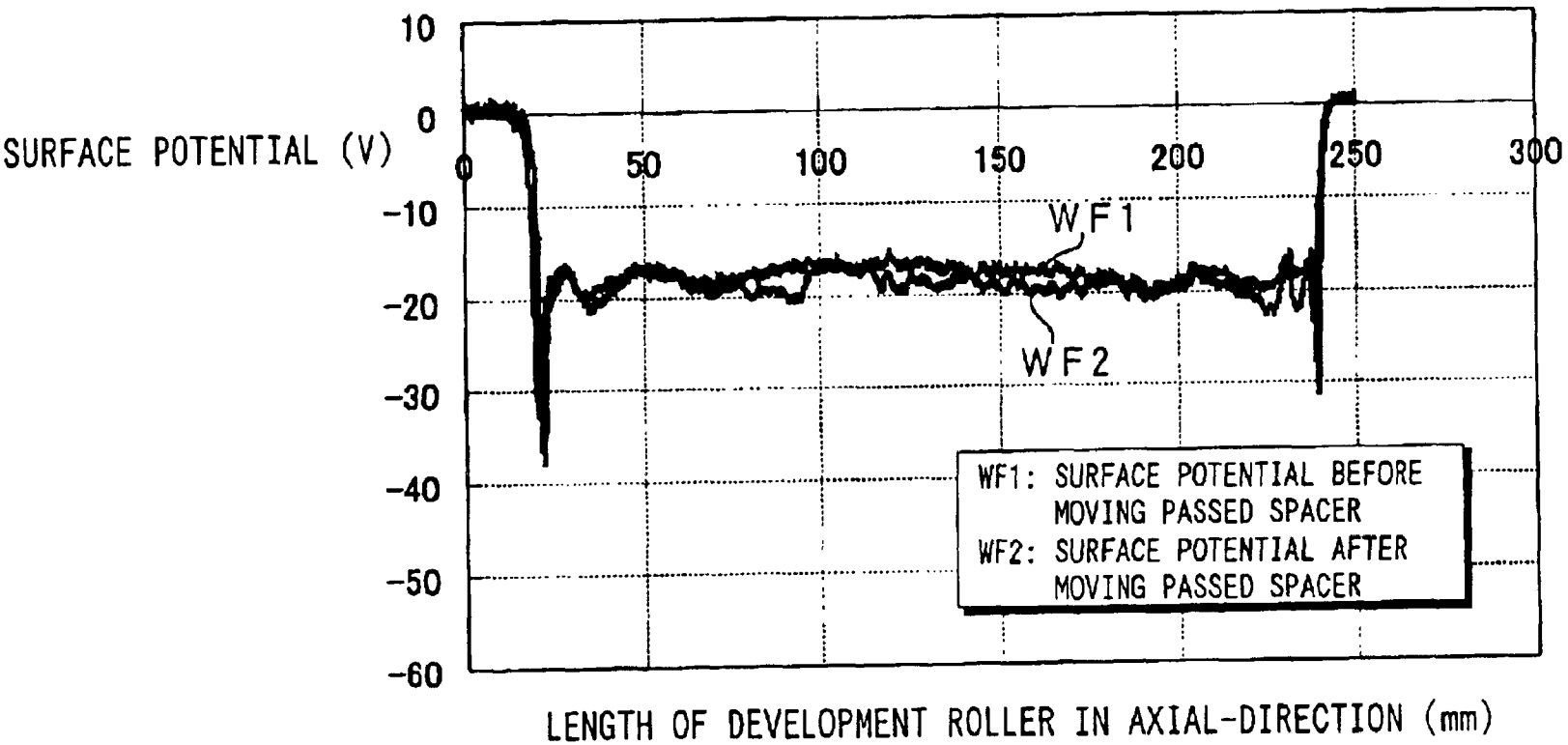
FIG. 9 is a drawing which shows surface potentials of the toner layer before and after the toner layer moves passed the spacer in a condition that the work function of the spacer and the work function of toner which forms the toner layer are approximately the same.

Further, according to this embodiment, the spacer 5 is made of a material whose work function is approximately the same as the work function of the toner T. The reason of this will now be described with reference to FIGS. 8 and 9. FIGS. 8 and 9 are drawings which show surface potentials of the toner layer before and after the toner layer moves passed the spacer in different conditions. FIG. 8 is a drawing which shows the surface potential in a condition that the work function of the spacer and the work function of toner which forms the toner layer have a relatively large difference between each other. And FIG. 9 is a drawing which is a drawing which shows the surface potential in a condition that the work function of the spacer and the work functions are approximately the same.

Experiments were conducted to examine an influence of the material of the spacer 5 over a surface potential of the toner layer TL in a condition that the spacer 5 abutted on the toner layer TL, and results as those shown in FIGS. 8 and 9 were obtained. In any one of the experiments shown in FIGS. 8 and 9, a stainless steel plate (work function: 5.43 eV) was used as the spacer 5, but different toner was used in these experiments. More specifically, toner T1 (work function: 5.62 eV) was used in the experiment shown in FIG. 8. The surface potential before and after the toner layer TL formed by the toner T1 moved passed the spacer 5 was plotted along an axial direction X of the development roller 12, which is the experiment result shown in FIG. 8. Meanwhile, in the experiment shown in FIG. 9, toner T2 (work function: 5.38 eV) which was different from the toner T1 was used. The surface potential before and after the toner layer TL formed by the toner T2 moved passed the spacer 5 was plotted along an axial direction X of the development roller 12, which is the experiment result shown in FIG. 9. In these experiments, the surface potential of the toner layer TL was measured using an electrostatic voltmeter (model number: MODEL344) available from TREK, INC.

As clearly seen from the experiment result shown in FIG. 8, a difference Δ between the work function of the spacer 5 and the work function of the toner T1 is 0.19 eV which is relatively large. As the spacer 5 comes into contact with the toner layer TL formed by the toner T1, electric charges move between the two, so that the surface potential of the toner layer TL largely changes before and after the toner layer TL moves passed the spacer 5. In this manner, an electrified state of the toner T1 changes immediately before getting transported to the toner transfer starting position J, the easiness of toner transfer also changes, and the quality of a toner image consequently deteriorates. Further, as comparison of a waveform WF1 representing the surface potential before the passage of the spacer 5 with a waveform WF2 representing the surface potential after the passage of the spacer 5 shows, not only the surface potential of the toner layer TL changes depending on whether the toner layer TL contacts with the spacer 5, but also the quantity of change in surface potential largely varies along the axial direction X of the development roller 12. More specifically, while the surface potential of the toner layer TL is approximately uniform in the axial direction X of the development roller 12 before the toner layer TL contacts the spacer 5 (See the waveform WF1.), after the toner layer TL leaves the spacer 5, the surface potential of the toner layer TL gets disturbed largely along the axial direction X (See the waveform WF2.). Hence, if the toner T1 is allowed to transfer despite the disturbed surface potential in the axial direction X, the disturbance will manifest itself as a deteriorated image quality of a toner image on the intermediate transfer belt 23. In reality, a toner image formed on the intermediate transfer belt 23 was visually inspected, and it was found that the image quality of the toner image was poor.

In contrast, as the experiment result in FIG. 9 clearly shows, when the toner layer TL is formed by the toner T2 (work function: 5.38 eV) having approximately the same work function as that of the spacer 5 (The difference Δ between the two work functions is 0.05 eV.), even as the spacer 5 comes into contact with the toner layer TL formed by the toner T2, movement of electric charges between the two is small. That is, as comparison of the two waveforms WF1 and WF2, one being the waveform WF1 representing the surface potential before the passage of the spacer 5 and the other being the waveform WF2 representing the surface potential after the passage of the spacer 5, in FIG. 9 shows, there is almost no change in surface potential. In addition, the surface potential of the toner layer TL is approximately uniform along the axial direction X of the development roller 12. Hence, it is possible to feed the toner T2 to the toner transfer starting position J without disturbing the surface potential of the toner layer TL by the spacer 5. In reality, a toner formed on the intermediate transfer belt 23 was visually inspected, and it was found that the image quality of the toner image was excellent.

Thus, as the work function of the spacer 5 and the work function of the toner which forms the toner layer TL are set to be approximately the same, it is possible to transport the toner T to the toner transfer starting position J while suppressing disturbance of the surface potential of the toner layer TL due to the spacer 5, and as a result, it is possible to allow the toner T to transfer easily and hence to stably form a toner image which has an excellent image quality.

Although an excellent toner image was not formed since the spacer 5 formed by a stainless steel plate was used for the toner T1 (work function: 5.62 eV) in the experiment described above, when the spacer 5 is formed by polyamide coated with dispersed carbon (work function: 5.52 eV) or urethane coated with dispersed carbon (work function: 5.64 eV) for example instead of a stainless steel plate, since the work function of the spacer 5 and the work function of the toner T1 which forms the toner layer TL are approximately the same merely leaving the difference Δ of 0.10 eV or 0.02 eV, it is possible to form an excellent toner image. In short, in an image forming apparatus of the TonerJet method, it is possible to form an excellent image if the toner and the spacer 5 are selected in such a manner that the work function of the spacer 5 and the work function of the toner which forms the toner layer TL become approximately the same.

Figure 10:
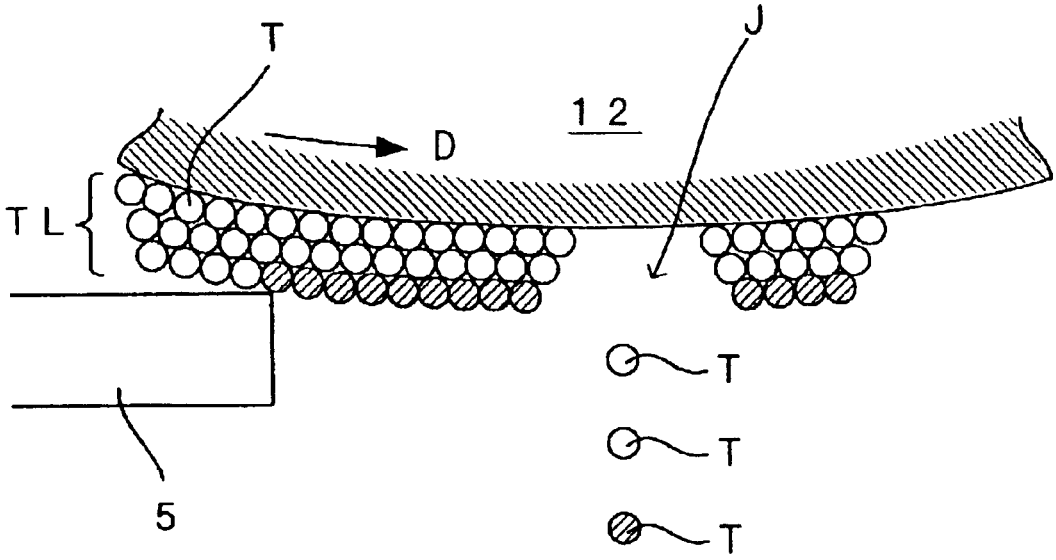
FIG. 10 is a drawing which schematically shows an electrified state of toner when the thickness of a toner layer is 3d.

The reason of restricting the thickness of the toner layer TL on the development roller 12 to 1d by means of the regulating blade 14 will now be described with reference to FIGS. 3 and 10. FIG. 10 is a drawing which schematically shows an electrified state of the toner when the thickness of the toner layer is 3d.

In the event that the spacer 5 partially abuts on the toner layer TL, electrified states of toner particles forming the toner layer TL may become different from each other depending on the thickness of the toner layer TL. The toner T carried on the development roller 12, after first electrified by friction with the supply roller 13, gets further electrified by friction with the regulating blade 14. Thus electrified toner T is considered to be in an approximately uniform electrified state regardless of the thickness of the toner layer TL, as denoted at white circle marks in FIGS. 3 and 10 for instance.

However, when the thickness of the toner layer TL is 2d or thicker, or about 3d as shown in FIG. 10, only those toner particles T located in the outer-most tier of the toner layer TL are in contact with the spacer 5, whereas those toner particles T located on the inner side to the outer-most tier are transported to the toner transfer starting position J while staying out of contact with the spacer 5. In FIG. 10, the hatched toner particles are the toner particles T whose electrified states change owing to contact with the spacer 5. FIG. 3 is similar in this respect.

As described above, when the toner T is comprised of more than one tiers which are stacked one atop the other as shown in FIG. 10 and such toner T is carried on the development roller 12, electrified states of the toner particles are different from each other depending on where in the toner layer TL these toner particles are located. Thus, the easiness of transfer is different between different toner particles T, and therefore, the quality of a toner image formed on the intermediate transfer belt 23 inevitably deteriorates.

In contrast, according to this embodiment, since the toner T on the development roller 12 is regulated by the regulating blade 14 to have the thickness of 1d, all toner particles T of the toner layer TL come into contact with the spacer 5 as they move passed the spacer 5 on their way to the toner transfer starting position J, and therefore, electrified states of the toner particles T are approximately the same. This allows to make the easiness of toner transfer uniform and hence stably form an image having an excellent quality with the toner T.

In this manner, in the image forming apparatus according to this embodiment, since the width Ws of the spacer 5 which defines the gap GP between the development roller 12 and the FPC 4 is set to be smaller than or equal to the width Wt of the toner layer TL on the development roller 12, an edge portion of the spacer 5 will not be deformed, which makes it possible to maintain the gap GP constant. Further, since the spacer 5 is made of a material whose work function is approximately the same as that of the toner T, contact with the spacer will cause almost no disturbance in surface potential of the toner layer TL. Still further, since the thickness of the toner layer TL on the development roller 12 is restricted to approximately 1d, electrified states of the respective toner particles T forming the toner layer TL are maintained approximately the same.

Maintaining the gap GP constant and continuously transporting the uniform toner layer TL to the toner transfer starting position J in this manner, this image forming apparatus is capable of stably forming a toner image having an excellent image quality.

Figure 11:
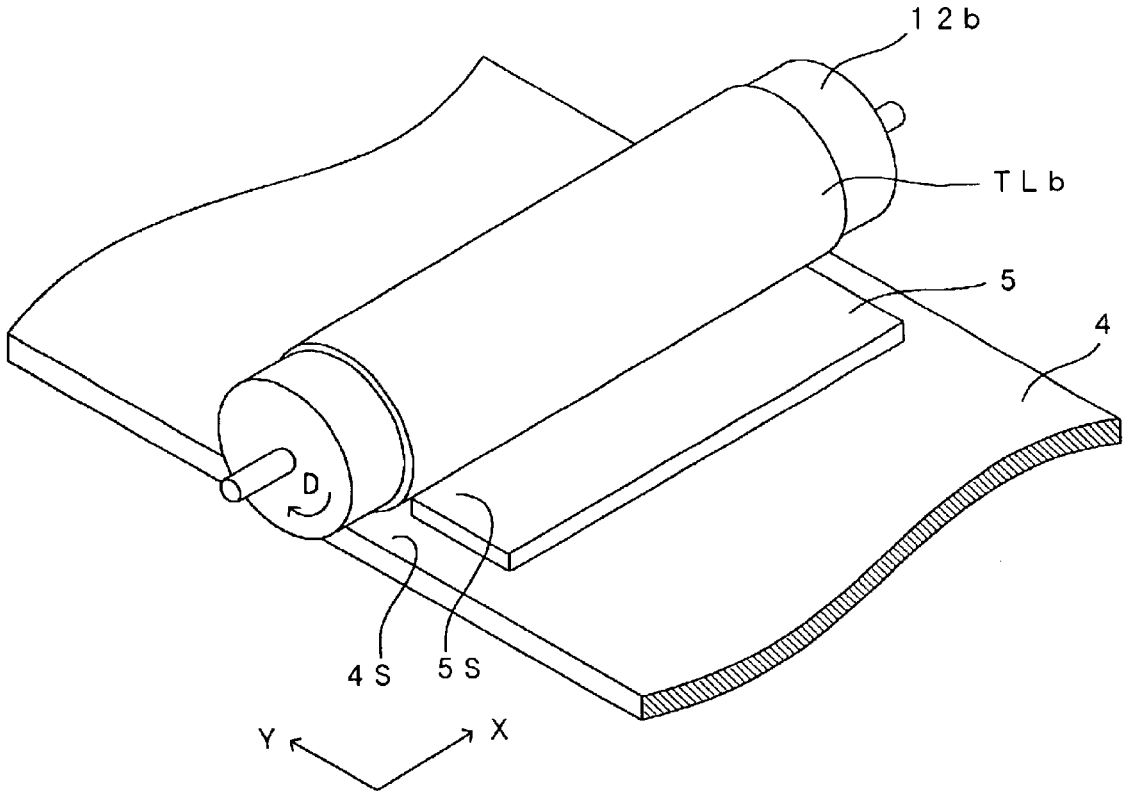
FIG. 11 is a drawing of a second preferred embodiment of an image forming apparatus according to the present invention.

A second preferred embodiment of the image forming apparatus according to the present invention will now be described with reference to FIG. 11. FIG. 11 is a drawing of a second preferred embodiment of an image forming apparatus according to the present invention.

The image forming apparatus according to the second preferred embodiment is different from the apparatus according to the first preferred embodiment in that there is no insulation layer disposed on the surface of the development roller and that the quantity of the toner transported by the development roller is restricted not by the thickness of the toner but by the toner mass per unit surface area. But the image forming apparatus according to the second preferred embodiment is the same as the first preferred embodiment in terms of other structures and operations. Therefore, the differences mentioned above will be described in detail.

In the image forming apparatus according to the second preferred embodiment, as shown in FIG. 11, no insulation layer is disposed on a surface of a development roller 12*b* which has a cylindrical shape, and metal, such as aluminum and iron, or metal alloy is exposed. As compared with the apparatus according to the first preferred embodiment, the apparatus according to the second preferred embodiment is more advantageous in terms of cost since no insulation layer is disposed to the development roller 12*b*, and is superior in terms of durability against wear. While the toner T needs exhibit electrical insulation because of the conductivity of the surface of the development roller 12*b*, resin toner which is normally used generally possesses electrical insulation, this structure does not demand any special toner.

When the development roller has such a structure, if the width of the toner layer is smaller than the width of a spacer 5*a* as in the conventional image forming apparatus shown in FIG. 6, an edge portion 51*a* of the spacer 5*a* extending outwards beyond the edge portion Ea of the toner layer gets deformed toward a development roller 12*a* and the spacer 5*a* and/or the FPC 4*a* eventually contacts the development roller 12*a*. In the event that the surface of the spacer 5*a* and/or the FPC 4*a* is conductive or semi-conductive and a different potential from that applied to the development roller 12*a* is applied to these elements, as these elements contact the development roller, short circuit may occur. Short circuit may disturb an electric field and accordingly degrade the image quality, which makes it impossible to form an image, or may even cause malfunction of the apparatus.

In contrast, in the image forming apparatus according to the second preferred embodiment, as in the apparatus according to the first preferred embodiment described earlier, the spacer 5 terminates within an edge portion Eb of a toner layer TLb. This prevents the spacer 5 from getting deformed, and hence, the spacer 5 or the FPC 4 from contacting the development roller 12*b* and short circuiting even if the surface 5*s* of the spacer 5 and/or the surface 4*s* of the FPC 4 facing to the development roller 12*b* is conductive or semi-conductive.

Figure 12:
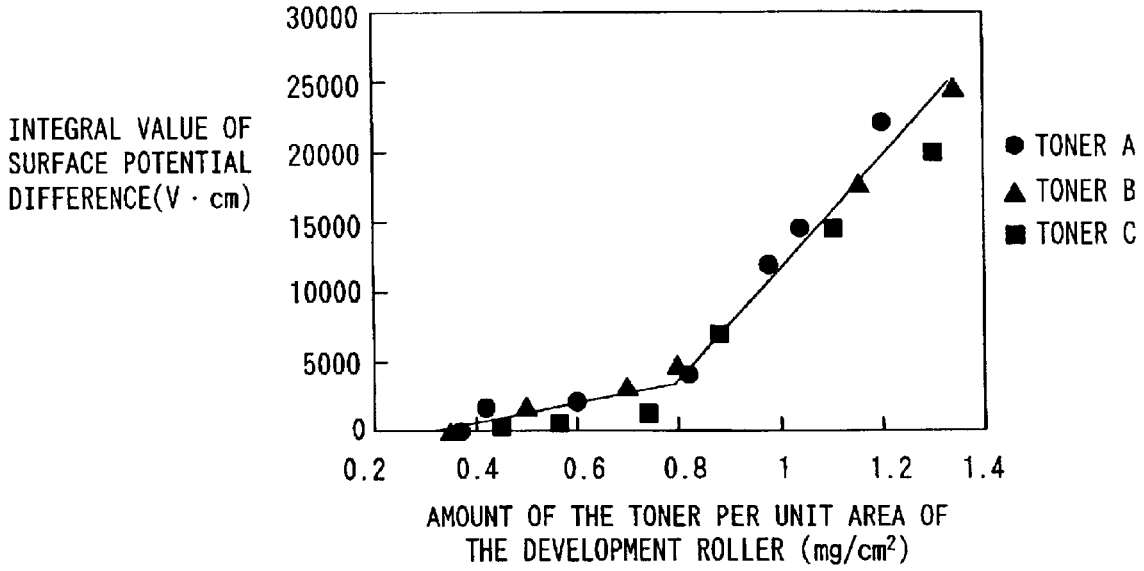
FIG. 12 is a graph which shows a change in integral value of surface potential difference of a toner layer relative to the amount of the toner deposited per unit area of the surface of the development roller.

Further, according to the second preferred embodiment, the regulating blade 14 restricts the amount of the toner T deposited per unit area of the surface of the development roller 12*b* as toner carrier to 0.8 mg/cm$^2$ or smaller. The reason of this will now be described with reference to FIG. 12. FIG. 12 is a graph which shows a change in integral value of surface potential difference of a toner layer relative to the amount of the toner deposited per unit area of the surface of the development roller.

An experiment was conducted to examine an influence of the amount of the toner T over a surface potential of the toner layer TL in a condition that the spacer 5 partially abuts on the toner layer TLb, and a result as that shown in FIG. 12 was obtained. Three types of toner A through C which are different from each other were prepared, and while transporting each type of toner in varying quantities, an integral value of surface potential difference which is indicative of disturbance in surface potential of the toner layer TL was calculated for each transported quantity. As for a "surface potential difference," surface potentials of the toner layer TLb before and after the toner layer TLb abutted on the spacer 5 were measured with an electrostatic voltmeter (model number: MODEL344) available from TREK, INC., and a difference between the two potentials was calculated. As thus calculated difference was integrated along the axial direction (X-direction) of the development roller 12, the "integral value of surface potential difference" in FIG. 12 was obtained.

As FIG. 12 clearly shows, during a period of time in which the amount of the toner T is relatively small, that is, while the amount of the toner T is 0.8 mg/cm$^2$ or smaller, the integral value of surface potential difference is relatively small and there is less disturbance in surface potential due to contact of the toner layer TLb with the spacer 5. Such a tendency is common regardless of the type of the toner T. On the other hand, as the amount of the toner T exceeds 0.8 mg/cm$^2$, the integral value of surface potential difference as well largely increases as the transported quantity increases, and the surface potential of the toner layer TLb gets largely disturbed due to contact of the toner layer TLb with the spacer 5.

Noting this, according to the second preferred embodiment, while defining the gap GP to a constant value by contacting the spacer 5 with the toner layer TLb, the transported quantity of the toner T is limited to 0.8 mg/cm$^2$ or smaller as described above, which allows to transport the toner T to the toner transfer starting position J while suppressing disturbance of the surface potential of the toner layer TL due to the spacer 5. As a result, it is possible to allow the toner T to transfer easily and hence to stably form a toner image which has an excellent image quality.

As described above, in the image forming apparatus according to the second preferred embodiment, as in the apparatus according to the first preferred embodiment described earlier, since the width Ws of the spacer 5 which defines the gap GP between the development roller 12*b* and the FPC 4 is set to be smaller than or equal to the width Wt of the toner layer TL on the development roller 12*b*, an edge portion of the spacer 5 will not be deformed. This makes it possible to maintain the gap GP constant and obviates unwanted contact of the spacer 5 and/or the FPC 4 with the development roller 12*b*. Further, since the amount of the toner T deposited on the development roller 12*b* is limited to 0.8 mg/cm$^2$ or smaller, disturbance of the surface potential of the toner layer TL is suppressed.

Maintaining the gap GP constant and continuously transporting the uniform toner layer TL to the toner transfer starting position J in this manner, this image forming apparatus is capable of stably forming a toner image having an excellent image quality.

The present invention is not limited to the preferred embodiments above but may be modified in various manners other than those described above to the extent that the modifications will not deviate from the intention of the invention. For instance, although each preferred embodiment above requires that the width of the FPC 4 is slightly wider than the width Wt of the toner layer TL for the purpose of preventing the toner which is on the development roller 12 or 12*b* beyond the spacer 5 from moving outside the FPC 4 and transferring toward the back electrode 3, the width of the FPC 4 is not limited to this but may be approximately the same as or narrower than the width Wt of the toner layer, or further alternatively, approximately the same as the width Ws of the spacer 5. However, in order to attain an excellent image quality all over an image forming region on the image receiving member, it is desired that the width Wt of the toner layer, the width Ws of the spacer and the width of the FPC are all wider than the width of the image forming region.

In addition, although each preferred embodiment above is an application of the present invention to an image forming apparatus of an intermediate transfer method in which after a toner image is formed on a transfer medium such as the intermediate transfer belt 23 for instance, the toner image on the transfer medium is transferred onto a sheet S, the present invention may be applied to an image forming apparatus in which the electrified toner T transferred from the developer 1 is allowed to arrive directly at the sheet S and an image is accordingly formed.

Further, although each preferred embodiment above is an application of the present invention to an image forming apparatus which uses the semi-conductive layers 49 for the purpose of preventing the FPC 4 from getting electrified, the present invention is not limited to such an application but may be applied to an image forming apparatus in which a semi-conductive layer for electrification prevention is not disposed.

Further, although each preferred embodiment above is an application of the present invention to an image forming apparatus in which the direction of transfer of the electrified toner T is switched among the three directions P1, P2 and P3 by means of the deflection electrodes 45L and 45R, the present invention is not limited to such an application but may be applied to an image forming apparatus in which the direction of transfer of the electrified toner T is fixed.

Further, although each preferred embodiment above requires to apply a predetermined volt direct current upon the development roller 12 from the development roller bias generator 103, the development roller 12 may be grounded or a volt alternating current may be applied upon the development roller 12.

Further, although each preferred embodiment above requires that the spacer 5 is in contact with the semi-conductive layers 49 and provided with the same ground potential as the semi-conductive layers 49 so that electrification of the spacer 5 will be prevented and an electric field will not be disturbed in the vicinity of the toner passing apertures 41, other bias potential may be applied to the spacer 5.

Further, although each preferred embodiment above is an application of the present invention to an image forming apparatus which forms an image with only one developer 1 to perform so-called monochrome printing, the present invention may be applied to a color image forming apparatus of the so-called tandem method in which similar developers 1 for four types of toner of yellow, magenta, cyan and black are disposed in one train along the feeding direction Y of the intermediate transfer belt 23 or the sheet S for instance to thereby form a full-color image.

Further, while two preferred embodiments which are combinations of the respective inventions have been described above as favorable implementations of the respective inventions, it is needless to mention that each invention may be implemented as it is alone or in other combinations than those described above. For instance, in the image forming apparatus according to the second preferred embodiment which comprises the development roller 12*b* whose surface does not seat an insulation layer, the thickness of the toner layer TL may be smaller than 2d as in the apparatus according to the first preferred embodiment. In addition, in an image forming apparatus which comprises a spacer whose width is wider than the width of the toner layer for example, the spacer may be made of a material whose work function is approximately the same as that of the toner.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image farming apparatus, comprising:

a back electrode;

a toner carrier which transports a toner layer, which is formed by electrified toner, to a toner transfer starting position which is faced with said back electrode while carrying said toner layer and moving in a predetermined travel direction;

toner transfer controlling means which is disposed between said toner carrier and said back electrode and controls toner transfer from said toner transfer starting position on said toner carrier toward said back electrode so that toner arrives at an image receiving member which is transported between said back electrode and said toner transfer controlling means and a toner image is accordingly formed; and gap defining means which comes in contact with said toner layer and accordingly defines a gap between said toner carrier and said toner transfer controlling means, wherein said gap defining means has a width in a width direction, which is perpendicular to said travel direction of said toner carrier, smaller than a width of said toner layer in said width direction and comes in contact with said toner layer within both edge portions of said toner layer in said width direction.

2. The image forming apparatus of claim 1, wherein said gap defining means comes in contact with said toner layer an upstream position to said toner transfer starting position in said travel direction of said toner carrier.

3. The image forming apparatus of claim 1, wherein said gap defining means comes in contact with said toner layer at a downstream position to said toner transfer starting position in said travel direction of said toner carrier.

4. The image forming apparatus of claim 1, wherein a toner carrier side surface of at least one of said gap defining means and said toner transfer controlling means and a surface of said toner carrier are conductive or semi-conductive, while said toner is non-conductive.

5. The image forming apparatus of claim 1, wherein said gap defining means is made of a material having a work function approximately the same as a work function of said toner.

6. An image forming apparatus, comprising:

a back electrode;

a toner carrier which transports a toner layer, which is formed by electrified toner, to a toner transfer starting position which is faced with said back electrode while carrying said toner layer and moving in a predetermined travel direction;

toner transfer controlling means which is disposed between said toner carrier and said back electrode and controls toner transfer from said toner transfer starting position on said toner carrier toward said back electrode so that toner arrives at an image receiving member which is transported between said back electrode and said toner transfer controlling means and a toner image is accordingly formed; and gap defining means which defines a gap between said toner carrier and said toner transfer controlling means, wherein said gap defining means is made of a material having a work function approximately the same as a work function of said toner, and comes in contact with said toner layer at an upstream position to said toner transfer starting Position in said travel direction of said toner carrier.

7. The image forming apparatus of claim 6, wherein the thickness of said toner layer carried on said toner carrier is restricted to smaller than 2d where the symbol d denotes a volume mean diameter of said toner.

8. The image forming apparatus of claim 7, wherein the thickness of said toner layer is restricted to approximately 1d.

9. The image forming apparatus of claim 6, wherein the quantity of said toner carried on said toner carrier is 0.8 $mg/cm^2$ or smaller.

10. An image forming apparatus, comprising:

a back electrode;

a toner carrier which transports a toner layer, which is formed by electrified toner, to a toner transfer starting position which is faced with said back electrode while carrying said toner layer and moving in a predetermined travel direction;

toner restricting means which restricts a quantity of said toner carried on said toner carrier to a predetermined value at an upstream position to said toner transfer starting position in said travel direction of said toner carrier;

toner transfer controlling means which is disposed between said toner carrier and said back electrode and controls toner transfer from said toner transfer starting position on said toner carrier toward said back electrode so that toner arrives at an image receiving member which is transported between said back electrode and said toner transfer controlling means and a toner image is accordingly formed; and gap defining means which comes in contact with said toner layer at a position between said toner transfer starting position and said toner restricting means and defines a gap between said toner carrier and said toner transfer controlling means, wherein said toner restricting means restricts a thickness of said toner layer to smaller than 2d where the symbol d denotes a volume mean diameter of said toner.

11. The image forming apparatus of claim 10, wherein said toner restricting means restricts the thickness of said toner layer to approximately 1d.

12. An image forming apparatus, comprising:

a back electrode;

a toner carrier which transports a toner layer, which is formed by electrified toner, to a toner transfer starting position which is faced with said back electrode which carrying said toner layer and moving in a predetermined travel direction;

toner restricting means which restricts a quantity of said toner carried on said toner carrier to a predetermined value at an upstream position to said toner transfer starting position in said travel direction of said toner carrier;

toner transfer controlling means which is disposed between said toner carrier and said back electrode and controls toner transfer from said toner transfer starting position on said toner carrier toward said back electrode so that toner arrives at an image receiving member which is transported between said back electrode and said toner transfer controlling means and a toner image is accordingly formed; and gap defining means which comes in contact with said toner layer at a position between said toner transfer starting position and said toner restricting means and defines a gap between said toner carrier and said toner transfer controlling means, wherein said toner restricting means restricts the quantity of said toner transported to said toner transfer starting position to 0.8 $mg/cm^2$ or smaller.

* * * * *